US009296596B2

(12) United States Patent
Cormack

(10) Patent No.: US 9,296,596 B2
(45) Date of Patent: Mar. 29, 2016

(54) HYBRID WEDGE JACK/SCISSOR LIFT LIFTING APPARATUS AND METHOD OF OPERATION THEREOF

(71) Applicant: Cameron Lanning Cormack, Edmonton (CA)

(72) Inventor: Cameron Lanning Cormack, Edmonton (CA)

( * ) Notice: Subject to any disclaimer, the term of this patent is extended or adjusted under 35 U.S.C. 154(b) by 461 days.

(21) Appl. No.: 13/652,288

(22) Filed: Oct. 15, 2012

(65) Prior Publication Data

US 2014/0103277 A1 Apr. 17, 2014

(51) Int. Cl.

| | |
|---|---|
| ***B66F 7/12*** | (2006.01) |
| ***B66F 7/06*** | (2006.01) |
| ***B66F 3/46*** | (2006.01) |
| ***B66F 7/08*** | (2006.01) |

(52) U.S. Cl.

CPC . *B66F 7/065* (2013.01); *B66F 3/46* (2013.01); *B66F 7/0666* (2013.01); *B66F 7/0691* (2013.01); *B66F 7/08* (2013.01)

(58) Field of Classification Search

CPC ..... B66F 7/065; B66F 7/0691; B66F 7/0666; B66F 3/46

USPC ..... 254/122, 124, 126, 128, 93 L, 93 R

See application file for complete search history.

(56) References Cited

U.S. PATENT DOCUMENTS

| | | | |
|---|---|---|---|
| 401,368 | A | 4/1889 | Piper |
| 1,545,223 | A | 7/1925 | Westrate |
| 1,942,945 | A | 1/1934 | Smith |
| 1,991,255 | A | 2/1935 | Martin |
| 2,132,343 | A | 10/1938 | Jarrett |
| 2,402,579 | A | 6/1946 | Ross |
| 2,480,916 | A | 9/1949 | Gibson |
| 2,501,001 | A | 3/1950 | Neely |
| 2,533,980 | A | 12/1950 | Weaver |
| 2,706,102 | A | 4/1955 | Cresci |
| 2,749,969 | A | 6/1956 | Tatter |
| 2,862,689 | A | 12/1958 | Dalrymple et al. |
| 2,945,551 | A | 7/1960 | Annin et al. |
| 3,032,319 | A | 5/1962 | Dale |
| 3,110,476 | A | 11/1963 | Farris |

(Continued)

FOREIGN PATENT DOCUMENTS

EP 704404 A1 * 4/1996

OTHER PUBLICATIONS

Machine Translation of Heinrichs EP 0704404A1 Apr. 3, 1996.*

(Continued)

*Primary Examiner* — Monica Carter
*Assistant Examiner* — Nirvana Deonauth
(74) *Attorney, Agent, or Firm* — Scott T. Griggs; Griggs Bergen LLP

(57) ABSTRACT

A hybrid wedge jack/scissor lift device for lifting heavy loads is provided, the device having a horizontally-oriented actuator coupled to a wedge that acts on lower and upper rollers coupled to a scissor lift. In operation, the actuator can drive the wedge in between the rollers, spreading them apart to raise the scissor lift. When the actuator retracts, the wedge is removed and the scissor lift collapses under the weight of the load. The wedge can be shaped in such a way that the lift has one or more intrinsically safe positions in which the rollers on the scissor lift fit into seats on the wedge, preventing the scissor lift from collapsing in the event of an actuator failure. An optional restraint bar safety mechanism is also provided.

4 Claims, 10 Drawing Sheets

(56) References Cited

U.S. PATENT DOCUMENTS

| | | | | |
|---|---|---|---|---|
| 3,292,902 | A | | 12/1966 | Lynch |
| 3,350,065 | A | | 10/1967 | Mankey |
| 3,390,862 | A | | 7/1968 | Schrepfer |
| 3,446,379 | A | | 5/1969 | Phillips |
| 3,556,481 | A | | 1/1971 | Mueller et al. |
| 3,727,490 | A | | 4/1973 | Diffenderfer et al. |
| 3,785,462 | A | | 1/1974 | Coad et al. |
| 3,889,778 | A | | 6/1975 | Dotts |
| 3,901,356 | A | * | 8/1975 | Butler ..... 187/211 |
| 3,983,960 | A | | 10/1976 | Sikli |
| 4,086,828 | A | | 5/1978 | Mader |
| 4,113,065 | A | | 9/1978 | Sikli |
| 4,114,854 | A | | 9/1978 | Clark |
| 4,175,644 | A | | 11/1979 | Sikli |
| 4,447,041 | A | | 5/1984 | Fujita |
| 4,457,403 | A | | 7/1984 | Ream |
| 4,457,657 | A | | 7/1984 | Karis et al. |
| 4,491,449 | A | | 1/1985 | Hawkins |
| 4,504,041 | A | | 3/1985 | Raz |
| 4,511,110 | A | | 4/1985 | Moller |
| 4,526,346 | A | | 7/1985 | Galloway et al. |
| 4,534,544 | A | | 8/1985 | Heide |
| 4,549,720 | A | | 10/1985 | Bergenwall |
| 4,577,821 | A | | 3/1986 | Edmo et al. |
| 4,585,212 | A | | 4/1986 | Yanker |
| 4,638,610 | A | | 1/1987 | Heikkinen |
| 4,659,066 | A | | 4/1987 | VanLierop |
| 4,724,930 | A | | 2/1988 | VanLierop |
| 4,753,419 | A | | 6/1988 | Johansson |
| 4,822,004 | A | | 4/1989 | Van Lierop |
| 4,830,147 | A | | 5/1989 | Kawada |
| 4,854,421 | A | | 8/1989 | Kawada |
| 4,858,482 | A | | 8/1989 | Knudsen |
| 4,890,692 | A | | 1/1990 | Oakman |
| 4,899,987 | A | | 2/1990 | Craig |
| 4,909,357 | A | | 3/1990 | Kawada |
| 5,054,578 | A | | 10/1991 | Smillie et al. |
| 5,056,977 | A | | 10/1991 | May |
| 5,131,501 | A | | 7/1992 | Yoshikawa |
| 5,192,053 | A | | 3/1993 | Sehlstedt |
| 5,322,143 | A | | 6/1994 | Curran |
| 5,503,368 | A | | 4/1996 | Torres |
| 6,045,122 | A | * | 4/2000 | Torres ..... 254/88 |
| 6,059,263 | A | | 5/2000 | Otema et al. |
| 6,516,478 | B2 | | 2/2003 | Cook et al. |
| 6,595,322 | B2 | | 7/2003 | Winter |
| 6,601,430 | B2 | | 8/2003 | McClellan |
| 6,679,479 | B1 | | 1/2004 | Watkins |
| 6,705,238 | B1 | | 3/2004 | Heckert |
| 6,742,768 | B2 | | 6/2004 | Alba |
| 6,814,188 | B1 | | 11/2004 | Heckert |
| 6,854,715 | B2 | | 2/2005 | Hicks et al. |
| 7,179,040 | B2 | | 2/2007 | Masuda et al. |
| 7,213,686 | B2 | | 5/2007 | Kaufman |
| 7,413,056 | B2 | | 8/2008 | Gonzi et al. |
| 7,552,683 | B2 | | 6/2009 | Hayashi |
| 8,015,638 | B2 | | 9/2011 | Shimada et al. |
| 2003/0047388 | A1 | | 3/2003 | Faitel |
| 2003/0075657 | A1 | | 4/2003 | Joubert |
| 2003/0168646 | A1 | | 9/2003 | Lopez Alba |

OTHER PUBLICATIONS

Enerpac (A division of Actuant Corp). Enerpac dozer lift system synchronously and safely hoists 100,000kg dozers. Mar. 7, 2012.

Hedweld USA Incorporated. Jack Stands Single and Twin Model 300 (Twin). Trilift Maintenance Support Equipment.

* cited by examiner

HYBRID WEDGE JACK/SCISSOR LIFT LIFTING APPARATUS AND METHOD OF OPERATION THEREOF

TECHNICAL FIELD OF THE INVENTION

The present disclosure is related to the field of jacks and lifts for use in safely raising and lowering heavy objects, in particular, wedge jacks and scissor lifts operated by linear actuators and that incorporate integral safety features.

BACKGROUND OF THE INVENTION

Various types of jacks and lifting devices are used in a wide variety of industries for lifting many different types of loads. Each of the various designs of jacks and lifting devices possesses distinct advantages and disadvantages. Thus, it is important to choose a design that is suited to the specific lifting requirements of the task at hand.

Scissor lifts, which are well known, are very compact and possess low height profiles. These characteristics allow scissor lifts to function when limited clearance is available beneath a load. Scissor lifts are also advantageous because they are simple in design, and provide a stable and parallel movement of the load-bearing surface with respect to the base of the lift. However, scissor lifts that are driven by horizontally-oriented actuators are very inefficient, particularly during the initial stage of the lift. During this initial stage, a relatively large amount of horizontal force is required to raise the load on the scissor lift because only a small percentage of the horizontal force is translated into vertical force.

Another well-known lifting apparatus is the wedge jack. Wedge jacks are advantageous in that they are capable of lifting very heavy loads and are also very simple in design. Shortcomings of wedge jacks include difficulty in designing a jack such that the load-bearing surface remains horizontally stationary as it moves vertically; issues with friction between the moving surfaces in the jack; and design constraints with respect to the positioning of the linear actuator that drives the jack as well as the overall housing of the jack, which must contain moving and stationary wedges over the range of the lift.

Both scissor lifts and wedge jacks share a common deficiency: if the linear force actuator supplying the force to lift the load fails in some way, the load is uncontrollably dropped to the resting position of the scissor lift or wedge jack. This can be particularly problematic when multiple scissor lifts or wedge jacks are being used since the load being lifted may become unbalanced and shift or slide unpredictably. The failure of such a lifting apparatus creates a risk of serious property damage as well as a safety concern for people working in the same area as the load. While some devices and techniques for preventing scissor lifts and wedge jacks from failing in this way are taught in the prior art, most of the safety measures disclosed are not integral to the design of lifting apparatus itself. These safety measures may fail of their own accord or be intentionally or unintentionally disengaged by an operator.

One particular situation that arises frequently and presents a number of challenges is where the load to be lifted is very heavy and there is minimal space in which to position a lifting apparatus underneath said load. A common example of this situation is where heavy vehicles such as construction machinery or military equipment must be lifted for maintenance or transportation purposes. Scissor lifts are not feasible for this purpose due primarily to their inefficiencies in the initial portion of the lift. Wedge jacks are generally too large and unstable for such a task, and are often incapable of lifting the load to the required height. Devices using vertically-oriented actuators are often used for such tasks, but these devices do not have compact, low height profiles and are often unable to fit between the load and the surface underneath. Such devices also carry the same safety risks as scissor lifts and wedge jacks with respect to the failure of the actuators used to lift the load.

It is, therefore, desirable to provide a hybrid wedge jack/scissor lift device that overcomes the shortcomings of the prior art lifting apparatus designs.

SUMMARY OF THE INVENTION

A wedge jack/scissor lift hybrid lifting apparatus is provided. In some embodiments, the hybrid lifting apparatus can comprise a wedge driven by a linear actuator, with the linear actuator fixed to a central trunnion of a scissor lift assembly and the wedge oriented within the scissor lift such that extending the actuator causes the wedge to raise the scissor lift, and retracting the actuator causes the wedge to lower the scissor lift.

In some embodiments, the scissor lift assembly can comprise first and second sides connected by upper and lower fixed pins, upper and lower sliding pins and a central trunnion. The first and second sides can comprise a first scissor arm, a second scissor arm, an L-shaped upper frame member and an L-shaped lower frame member. The first and second scissor arms can each further comprise a fixed end having an end pin passage for receiving one of the fixed pins, a sliding end having an end pin passage for receiving one of the sliding pins and a central trunnion passage for receiving the central trunnion. The L-shaped upper frame member can comprise a downward-projecting main body having a fixed pin passage and a sliding pin slot and an outward-projecting flange. The L-shaped lower frame member can further comprise an upward-projecting main body having a fixed pin passage and a sliding pin slot and an outward-projecting flange. The upper fixed pin can pass through the fixed pin passage of the L-shaped upper frame member and the end pin passage of the fixed end of the first scissor arm of the first side of the scissor lift assembly, then through the end pin passage of the fixed end of the first scissor arm and the fixed pin passage of the L-shaped upper frame member of the second side of the scissor lift assembly, respectively. The lower fixed pin can pass through the fixed pin passage of the L-shaped lower frame member and the end pin passage of the fixed end of the second scissor arm of the first side of the scissor lift assembly, then through the end pin passage of the fixed end of the second scissor arm and the fixed pin passage of the L-shaped lower frame member of the second side of the scissor lift assembly, respectively. Both the upper fixed pin and the lower fixed pin can be fixed in place with respect to the upper frame members of both sides of the scissor lift assembly and the lower frame members of both sides of the scissor lift assembly, respectively. The first scissor arms of both sides of the scissor lift assembly and the second scissor arms of both sides of the scissor lift assembly can rotate freely about the upper fixed pin and the lower fixed pin, respectively. Both first scissor arms and both second scissor arms can be positioned coaxially about the central trunnion, which can pass through the central trunnion passages of the second scissor arm and the first scissor arm of the first side of the scissor lift assembly, then through the central trunnion passages of the first scissor arm and the second scissor arm of the of the second side of the scissor lift assembly, respectively. Both first scissor arms and both second scissor arms can rotate freely about the central trunnion. The upper sliding pin can pass through the sliding pin slot of the L-shaped upper frame member and the end pin passage of the sliding end of the second scissor arm of the first side of the scissor lift assembly, then through the end pin passage of the sliding end of the second scissor arm and the sliding pin slot of the L-shaped upper frame member of the second side of the scissor lift assembly, respectively. The lower sliding pin can pass through the sliding pin slot of the L-shaped lower frame member and the end pin passage of the sliding end of the first scissor arm of the first side of the scissor lift assembly, then through the end pin passage of the sliding end of the first scissor arm and the sliding pin slot of the L-shaped lower frame member of the second side of the scissor lift assembly, respectively. The second scissor arms of both sides of the scissor lift assembly and the first scissor arms of both sides of the scissor lift assembly can rotate freely about the upper sliding pin and the lower sliding pin, respectively. The upper sliding pin can be free to slide back and forth within the sliding pin slots of both L-shaped upper frame members, and the lower sliding pin can be free to slide back and forth within the sliding pin slots of both L-shaped lower frame members.

In some embodiments, the L-shaped upper frame members and the L-shaped lower frame members can further comprise flange bolt passages disposed through their respective flanges and a trunnion recess in each of the edges of their respective main bodies, with the trunnion recess positioned such that when the scissor lift is fully lowered, the trunnion recesses of the downward-projecting main bodies of the L-shaped upper frame members can sit over top of the central trunnion while the central trunnion rests in the trunnion recesses of the upwardly-projecting main bodies of the L-shaped lower frame members.

In some embodiments, the scissor lift assembly can further comprise an upper wedge roller and a lower wedge roller positioned coaxially with the upper and lower fixed pins, respectively. Both wedge rollers can be positioned between the two sides of the scissor lift assembly, with the upper fixed pin passing through the center of the upper wedge roller and the lower fixed pin passing through the center of the lower wedge roller. The diameter of the wedge rollers can be such that they extend beyond the edges of the main bodies of the L-shaped upper frame members and the L-shaped lower frame members. The scissor lift assembly can be at its lowest point when the bottom of the upper wedge roller rests on the top of the lower wedge roller.

In some embodiments, the hybrid lifting apparatus can further comprise a wedge attached to an actuator rod that can be extended and retracted by a linear actuator, with the linear actuator fixed in place by the central trunnion between the first and second sides of the scissor lift assembly. The wedge and linear actuator can be oriented such that the tip of the wedge points in the direction of the fixed pins of the scissor lift assembly. With the linear actuator fully retracted, the hybrid lifting apparatus can be at its lowest point, with the bottom of the upper wedge roller resting on the top of the lower wedge roller. As the linear actuator extends, the wedge can be driven between the two wedge rollers. The upper wedge surface can push on the upper wedge roller and the lower wedge surface pushes on the lower wedge roller. This can cause the scissor lift assembly to extend, with the upper and lower sliding pins moving towards the upper and lower fixed pins, respectively, the scissor arms rotating from a substantially horizontal position to an increasingly vertical position, and the L-shaped upper frame members moving straight up, away from the L-shaped lower frame members. When the linear actuator retracts, the process can reverse and the hybrid lifting apparatus can retract towards its resting position at its lowest point.

In some embodiments, one or both of the upper or lower wedge rollers can comprise a guided wedge roller. The guided wedge roller can comprise a main body with a length corresponding to the width of the wedge, and two disc-shaped wedge guides positioned at the ends of the main body, the wedge guides having a diameter greater than that of the main body. The wedge surface can rest on the main body while the wedge guides can resist lateral movement of the wedge.

In some embodiments, the wedge can further comprise one or more pairs of concave wedge roller seats. Each pair of wedge roller seats can comprise a wedge roller seat on the upper wedge surface, and a corresponding wedge roller seat on the lower wedge surface, the wedge roller seats situated directly opposite from one another. The concave shape of the wedge roller seats can be such that the when the wedge is in a position where the wedge rollers are sitting in a pair of wedge roller seats, the hybrid lift apparatus can be in an intrinsically safe position whereby the wedge cannot move and, thus, the scissor lift assembly cannot collapse unless a force sufficient to raise the load on the hybrid lifting apparatus acts on the wedge and removes the wedge rollers from the wedge roller seats.

In some embodiments, the hybrid lifting apparatus can further comprise a load plate with plate bolt passages. Bolts can pass through the plate bolt passages and the flange bolt passages of the L-shaped upper members, and can be fixed in place with plate nuts to secure the load plate to the hybrid lift assembly.

In some embodiments, the load plate can further comprise a cradle fixed to the top of the load plate. The cradle can be oriented and shaped to prevent loads from shifting atop the load plate.

In some embodiments, the hybrid lifting apparatus can further comprise a base plate with plate bolt passages. Bolts can pass through the plate bolt passages and the flange bolt passages of the L-shaped lower members, and can be fixed in place with plate nuts to secure the base plate to the hybrid lift assembly.

In some embodiments, the scissor lift assembly can further comprise support discs positioned coaxially with the upper and lower sliding pins, with the fixed pins passing through the center of the support discs. The diameter of the support discs can be such that they transfer the vertical forces exerted on the upper and lower sliding pins by the second and first scissor arms to the load plate and the base plate, respectively.

In some embodiments, the hybrid lifting apparatus can further comprise between one and four restraint bar safety systems, each restraint bar safety system comprising a restraint bar actuator and a restraint bar, each restraint bar having a restraint bar pin passage, one or more sliding pin seats and a restraint bar actuator attachment point. Each of the restraint bar safety systems can be associated with one of the L-shaped frame members, and the fixed and sliding pins associated with that L-shaped frame member. For each restraint bar safety system, a fixed pin can extend out through an L-shaped frame member and passes through a restraint bar's restraint bar pin passage. The restraint bar can be free to rotate about the associated fixed pin. The restraint bar can comprise a restraint bar actuator attachment point at the end opposite the restraint bar pin passage. This attachment point can be coupled to one end of the restraint bar safety system's restraint bar actuator. The other end of the restraint bar actuator can be fixed to a point on the associated L-shaped frame member. The restraint bar actuator can be oriented such that when the restraint bar actuator extends, the restraint bar can swing out and away from the flange of the associated L-shaped frame member. When the restraint bar actuator is extended far enough that the one or more sliding pin seats of the restraint bar are clear of the associated sliding pin, the hybrid lifting apparatus can be free to operate normally. When restraint bar actuator is retracted such that the restraint bar is in a position where the associated sliding pin can rest in one of the one or more sliding pin seats, the restraint bar safety system can be engaged. The hybrid lifting apparatus can be lowered into a position where the associated sliding pin rests in the one of one or more sliding pin seats and the hybrid lifting apparatus is secured in place in that position.

In some embodiments, a vertical tandem hybrid lifting apparatus is provided, the vertical tandem hybrid lifting apparatus comprising lower and upper hybrid lifting apparatuses attached by joining the L-shaped upper frame members of the lower hybrid lifting apparatus to the corresponding L-shaped lower frame members of the upper hybrid lifting apparatus.

In some embodiments, a simplified hybrid lifting apparatus is provided, the simplified hybrid lifting apparatus comprising a simplified scissor lift assembly having a compact load plate assembly and first and second sides connected by upper and lower fixed pins, a lower sliding pin and a central trunnion. The compact load plate assembly can further comprise a compact load plate having plate bolt passages and first and second load plate flanges, with each on one side of the compact load plate and each having a flange pin passage. The first and second sides can further comprise a first scissor arm, a first lever arm and an L-shaped lower frame member. The first scissor arm can further comprise a fixed end having an end pin passage for receiving one of the fixed pins, a sliding end having an end pin passage for receiving the sliding pin and a central trunnion passage for receiving the central trunnion. The first lever arm can further comprise a fixed end having an end pin passage for receiving the lower fixed pin and a rotatable end having an end trunnion passage for receiving the central trunnion. The L-shaped lower frame member can further comprise an upward-projecting main body having a fixed pin passage and a sliding pin slot and an outward-projecting flange. The lower fixed pin passes through the fixed pin passage of the L-shaped lower frame member and the end pin passage of the fixed end of the first lever arm of the first side of the simplified scissor lift assembly, then through the end pin passage of the fixed end of the first lever arm and the fixed pin passage of the L-shaped lower frame member of the second side of the scissor lift assembly, respectively. The upper fixed pin passes through the flange pin passage of the first flange and the end pin passage of the fixed end of the first scissor arm of the first side of the simplified scissor lift assembly, then through the end pin passage of the fixed end of the first scissor arm of the second side of the simplified scissor lift assembly and the flange pin passage of the second flange, respectively. The upper fixed pin may be fixed in place with respect to the first and second flanges and the lower fixed pin may be fixed in place with respect to the L-shaped lower frame members. The first lever arms of both sides of the simplified scissor lift assembly are free to rotate about the lower fixed pin. The first scissor arms of both sides of the simplified scissor lift are free to rotate about the upper fixed pin. The central trunnion passes through the central trunnion passage of the first scissor arm and the end trunnion passage of the first lever arm of the first side of the simplified scissor lift assembly, then through the end trunnion passage of the first lever arm and the central trunnion passage of the first scissor arm of the second side of the simplified scissor lift assembly, respectively. Both first lever arms and both first scissor arms rotate freely about the central trunnion. The lower sliding pin passes through the sliding pin slot of the L-shaped lower frame member and the end pin passage of the sliding end of the first scissor arm of the first side of the simplified scissor lift assembly, then through the end pin passage of the sliding end of the first scissor arm and the sliding pin slot of the L-shaped lower frame member of the second side of the simplified scissor lift assembly, respectively. The first scissor arms of both sides of the simplified scissor lift assembly rotate freely about the lower sliding pin. The lower sliding pin is free to slide back and forth within the sliding pin slots of the L-shaped lower frame member.

In some embodiments, the simplified hybrid lifting apparatus can further comprise one or two restraint bar safety systems. Each of the restraint bar safety systems is associated with one of the L-shaped lower frame members and the fixed and sliding pins associated with that L-shaped lower frame member.

In some embodiments, a horizontal tandem simplified hybrid lifting apparatus is provided, the horizontal tandem simplified hybrid lifting apparatus comprising first and second simplified hybrid lifting apparatuses attached together in an end-to-end configuration such that the linear actuators of the first and second simplified hybrid lifting apparatuses oppose one another. The first and second hybrid lifting apparatuses may be joined together by using common L-shaped lower frame members and a common base plate. The common L-shaped lower frame members are formed by attaching two L-shaped lower frame members in an end-to-end configuration, with the sliding pin slots of each L-shaped lower frame member adjacent to one another. The common base plate further comprises plate bolt passages. Bolts pass through the plate bolt passages and the flange bolt passages of the common L-shaped lower members and are fixed in place with plate nuts to secure the common base plate.

In some embodiments, a centrally-controlled hybrid lifting apparatus array is provided, the centrally-controlled hybrid lifting apparatus array comprising two or more hybrid lifting apparatuses controlled by a controller connected to each of the hybrid lifting apparatuses in the array by a control cable.

Broadly stated, in some embodiments, a lifting apparatus is provided, comprising: a scissor lift assembly, further comprising: an upper frame operatively disposed above a lower frame, a pair of scissor braces operatively disposed between the upper frame and the lower frame, each brace further comprising first and second arms pivotally attached to each other, each arm further comprising a first end and a second end, a first fixed pin pivotally attaching the first end of the first arms to the upper frame, and a second fixed pin pivotally attaching the first end of the second arms to the lower frame, a first sliding pin disposed in a first slot disposed in the upper frame, the first sliding pin further disposed through the second end of the second arms wherein the first sliding pin can move along the first slot, and a second sliding pin disposed in a second slot disposed in the lower frame, the second sliding pin further disposed through the second end of the first arms wherein the second sliding pin can move along the second slot; a linear actuator disposed between the upper frame and the lower frame, the linear actuator configured to extend and retract; and a wedge comprising upper and lower wedge surfaces, the wedge operatively coupled to the linear actuator, the wedge configured to extend between the first fixed pin and the second fixed pin when the linear actuator is extended wherein the upper frame can be raised relative to the lower frame when the linear actuator is extended, and wherein the upper frame can be lowered relative to the lower frame when the linear actuator is retracted.

Broadly stated, in some embodiments, the scissor lift assembly can further comprise a first roller rotatably disposed about the first fixed pin, and a second roller rotatably disposed about the second fixed pin, wherein the wedge extends between the rollers when the linear actuator is extended.

Broadly stated, in some embodiments, the wedge can further comprise at least one first concave indentation disposed on the upper wedge surface, and at least one second concave indentation disposed on the lower wedge surface, the at least one first and second concave indentations shaped to receive the first roller and the second roller, respectively, wherein retracting the wedge from a position where the rollers are resting in the first and second at least one concave indentations requires sufficient force to raise the upper frame slightly upward.

Broadly stated, in some embodiments, the lower frame can further comprise a base plate, the base plate configured to improve the structural integrity of the lower frame.

Broadly stated, in some embodiments, the lifting apparatus can further comprise at least one first support disc disposed about the second sliding pin, the at least one first support disc configured to transfer forces from the second sliding pin to the base plate.

Broadly stated, in some embodiments, the upper frame can further comprise a load plate, the load plate configured to improve the structural integrity of the upper frame and to facilitate the placement of loads thereon.

Broadly stated, in some embodiments, the lifting apparatus can further comprise at least one second support disc disposed about the first sliding pin, the at least one second support disc configured to transfer forces from the first sliding pin to the load plate.

Broadly stated, in some embodiments, the lifting apparatus can further comprise at least one restraint bar safety system, the at least one restraint bar safety system comprising a restraint bar capable of being engaged and disengaged by a restraint bar actuator, wherein the restraint bar is configured to engage the second sliding pin to prevent the apparatus from collapsing.

Broadly stated, in some embodiments, a vertical tandem lift system is provided, comprising two or more lifting apparatuses stacked one on top of the other.

Broadly stated, in some embodiments, a horizontal tandem lift system is provided, comprising two lifting apparatuses arranged end to end such that the linear actuators of the apparatuses extend away from each other.

Broadly stated, in some embodiments, a hybrid lifting system array is provided, comprising: two or more lifting apparatuses; and a central controller operatively coupled to the two or more lifting apparatuses, the central controller configured for controlling the two or more lifting apparatuses.

Broadly stated, in some embodiments, an actuator system is provided, comprising: a wedge comprising upper and lower wedge surfaces, the wedge operatively coupled to a linear actuator; two sets of a pair of lever arms, each pair of lever arms comprising a first lever arm and a second lever arm, each lever arm comprising a trunnion end and a pin end, the trunnion ends of one set of lever arms pivotally coupled to one side of the linear actuator about a central axis, the trunnion ends of the other set of lever arms pivotally coupled to an opposing side of the linear actuator about the central axis; a first lever pin operatively coupling the pin end of the first lever arm of one of the pair of lever arms to the pin end of the first lever arm of the other of the pair of lever arms; a second lever pin operatively coupling the pin end of the second lever of one of the pair of lever arms to the pin end of the second lever arm of the other of the pair of lever arms; a first roller rotatably disposed about the first lever pin between the two sets of lever arms, with each roller positioned coaxially with a lever pin between a set of lever arms; and a first roller rotatably disposed about the first lever pin between the two sets of lever arms, with each roller positioned coaxially with a lever pin between a set of lever arms wherein the linear actuator and wedge are oriented such that the linear actuator can extend the wedge to spread the rollers apart, causing the first and second lever arms to rotate about the central axis.

Broadly stated, in some embodiments, the wedge can further comprise at least one first concave indentation disposed on the upper wedge surface, and at least one second concave indentation disposed on the lower wedge surface, the at least one first and second concave indentations shaped to receive the first roller and the second roller, respectively.

Broadly stated, in some embodiments, a lifting apparatus is provided, comprising: a scissor lift assembly, further comprising: an upper frame operatively disposed above a lower frame, a pair of first arms operatively disposed between the upper frame and the lower frame, each first arm further comprising a first end and a second end, a second arm comprising a first end and a second, the first end of the second arm pivotally attached to the first arm, a first fixed pin pivotally attaching the first end of the first arms to the upper frame, and a second fixed pin pivotally attaching the second end of the second arms to the lower frame, and a sliding pin disposed in a slot disposed in the lower frame, the sliding pin further disposed through second end of the first arms wherein the sliding pin can move along the slot, a linear actuator disposed between the upper frame and the lower frame, the linear actuator configured to extend and to retract; and a wedge comprising upper and lower wedge surfaces, the wedge operatively coupled to the linear actuator, the wedge configured to extend between the first fixed pin and the second fixed pin when the linear actuator is extended wherein the upper frame can be raised relative to the lower frame when the linear actuator is extended, and wherein the upper frame can be lowered relative to the lower frame when the linear actuator is retracted.

DETAILED DESCRIPTION OF THE INVENTION

Figure 1:
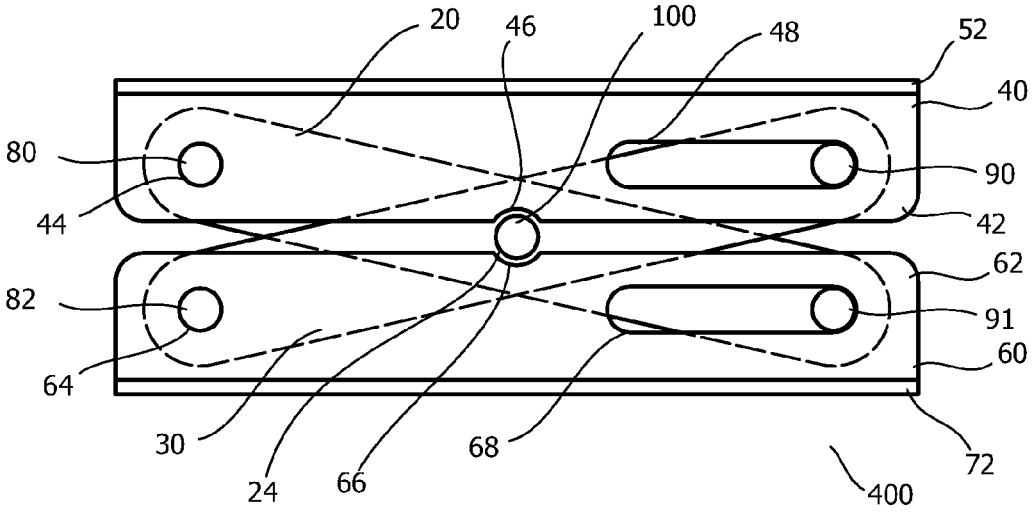
FIG. 1 is a side elevation view depicting a scissor lift assembly in a collapsed position.
Figure 2:
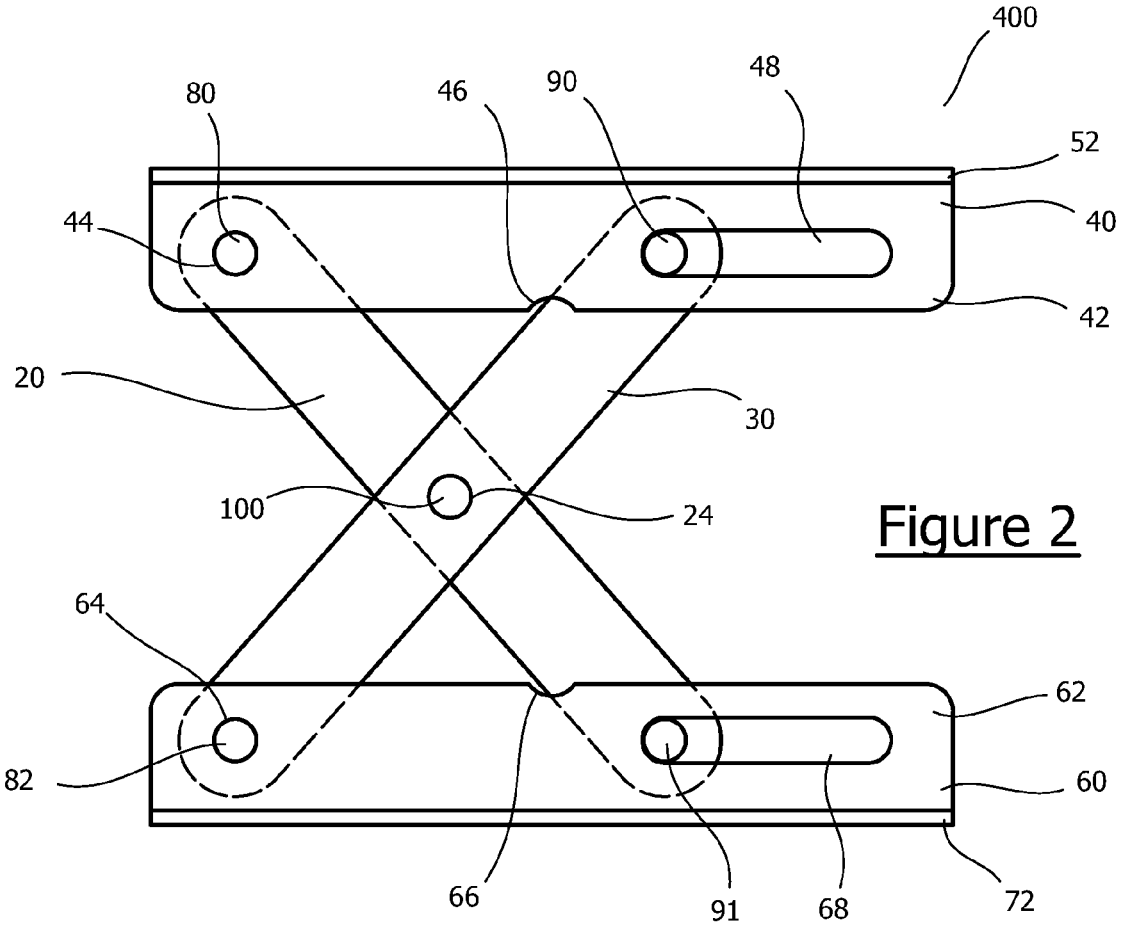
FIG. 2 is a side elevation view depicting a scissor lift assembly in an extended position.
Figure 3:
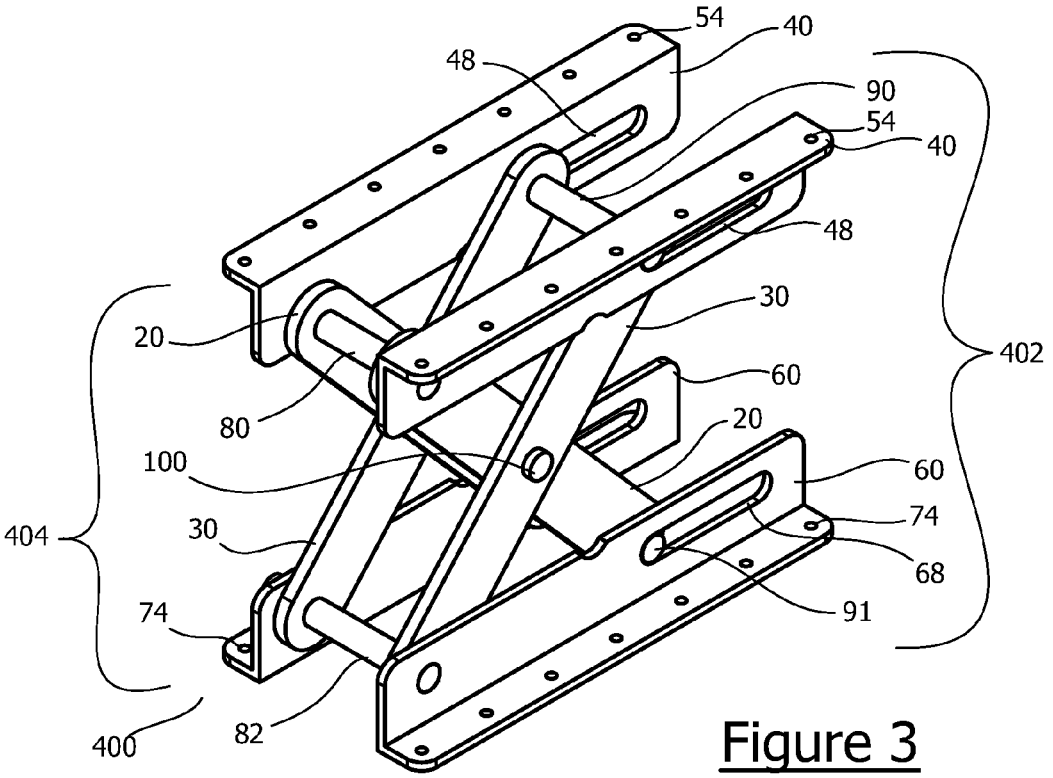
FIG. 3 is a perspective view depicting the scissor lift assembly of FIG. 2.
Figure 4:
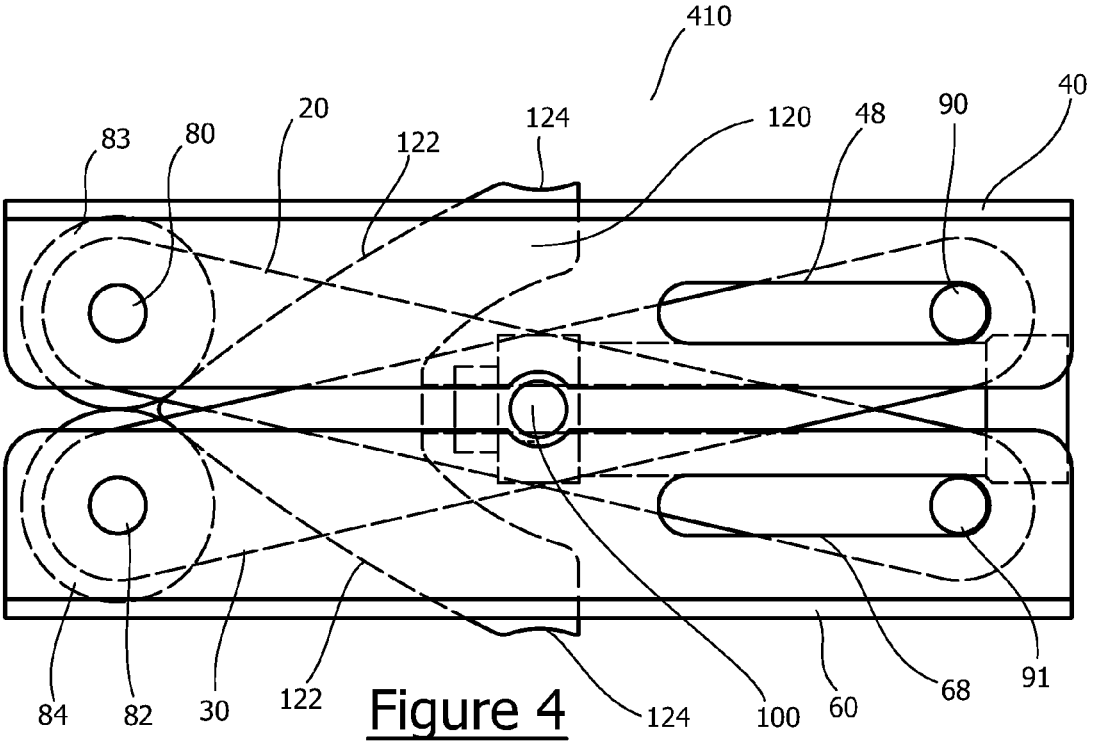
FIG. 4 is a side elevation view depicting a first embodiment of a hybrid wedge jack/scissor lift lifting apparatus in a collapsed position.
Figure 5:
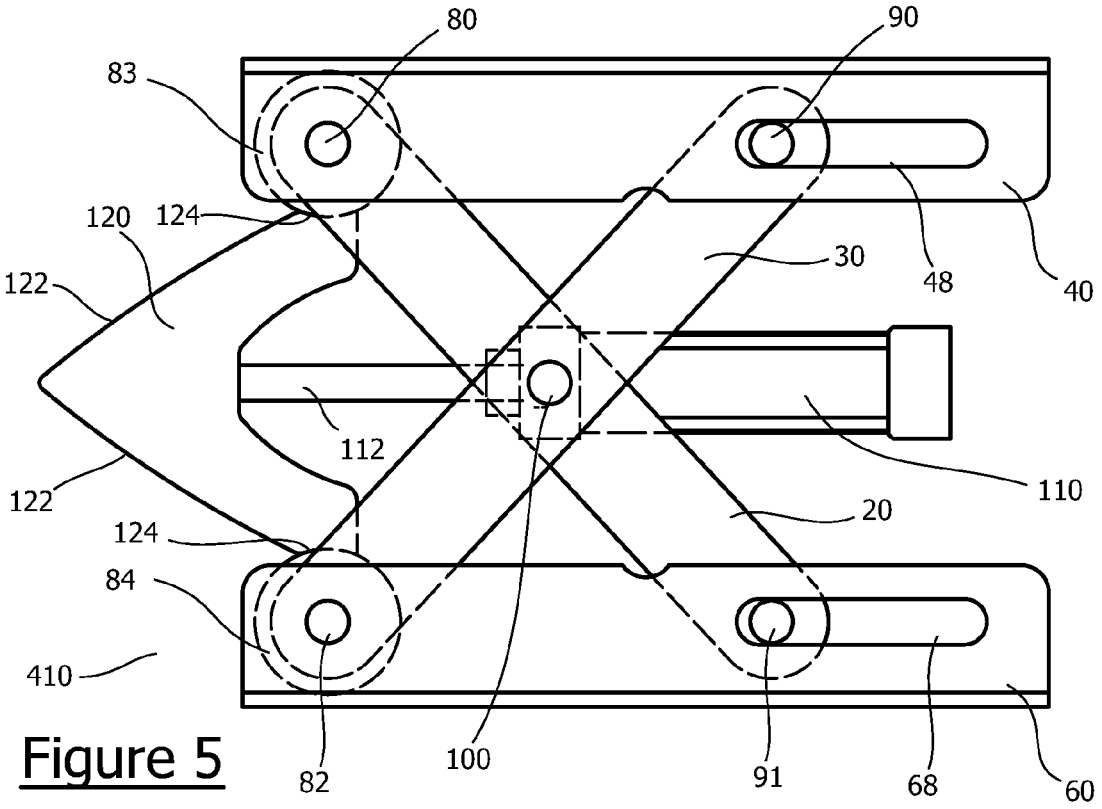
FIG. 5 is a side elevation view depicting the hybrid wedge jack/scissor lift lifting apparatus of FIG. 4 in an extended position.
Figure 6:
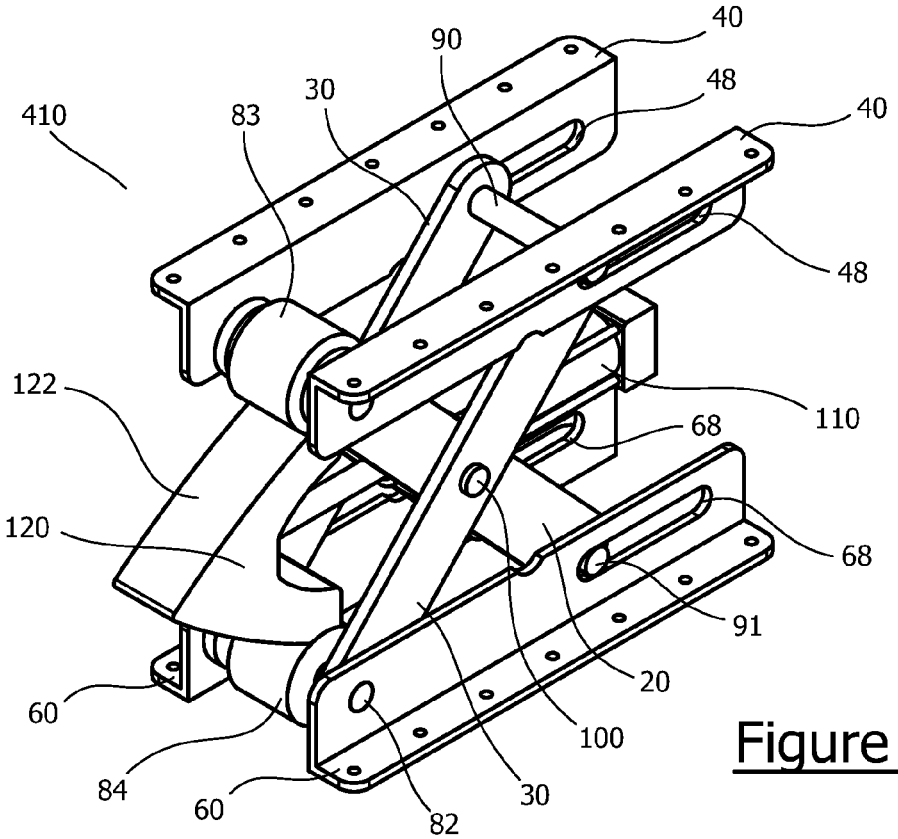
FIG. 6 is a perspective view depicting the hybrid wedge jack/scissor lift lifting apparatus of FIG. 5.
Figure 7:
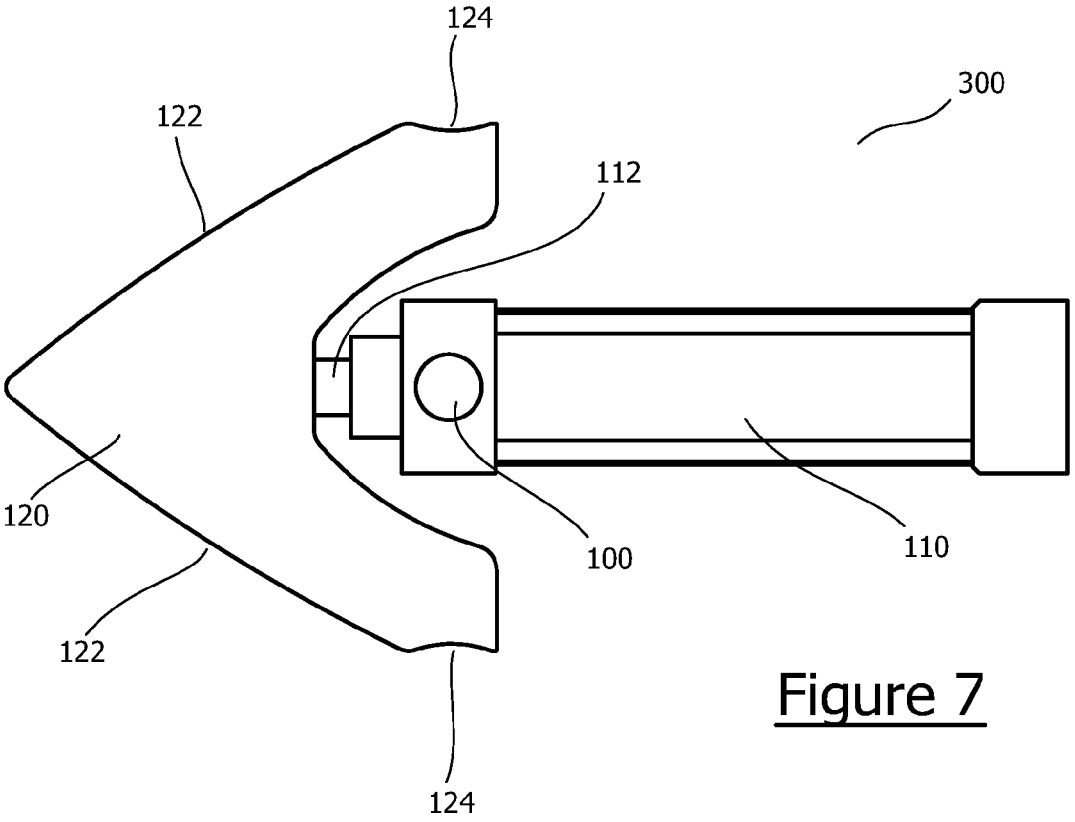
FIG. 7 is a side elevation view depicting a first embodiment of an actuator/wedge assembly.
Figure 8:
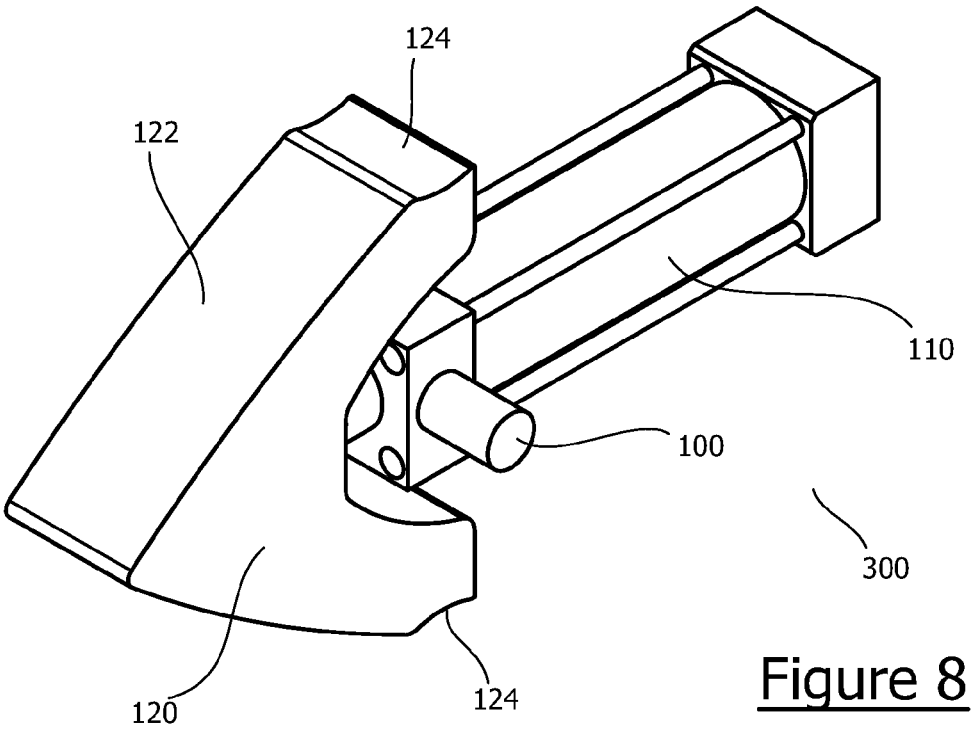
FIG. 8 is a perspective view depicting the actuator/wedge assembly of FIG. 7.

Referring to FIGS. 1 through 3, one embodiment of a scissor lift assembly is shown. In this embodiment, scissor lift assembly 400 can comprise first side 402 and second side 404 connected by upper fixed pin 80 and lower fixed pin 82, upper sliding pin 90 and lower sliding pin 91 and central trunnion 100. First side 402 and second side 404 can further comprise first scissor arm 20, second scissor arm 30, L-shaped upper frame member 40 and L-shaped lower frame member 60. First scissor arm 20 can further comprise fixed end 26 having end pin passage 22 for receiving upper fixed pin 80, sliding end 28 having end pin passage 22 for receiving lower sliding pin 91 and central trunnion passage 24 for receiving central trunnion 100. Second scissor arm 30 can further comprise fixed end 36 having end pin passage 32 for receiving lower fixed pin 82, sliding end 38 having end pin passage 32 for receiving upper sliding pin 90 and central trunnion passage 34 for receiving central trunnion 100. L-shaped upper frame member 40 can further comprise main body 42 having fixed pin passage 44 and sliding pin slot 48 and flange 52 having flange bolt passages 54. L-shaped lower frame member 60 can further comprise main body 62 having fixed pin passage 64 and sliding pin slot 68 and flange 72 having flange bolt passages 74. Upper fixed pin 80 can pass through fixed pin passage 44 of L-shaped upper frame member 40 and end pin passage 22 of fixed end 26 of first scissor arm 20 of scissor lift assembly first side 402, then through end pin passage 22 of fixed end 26 of first scissor arm 20 and fixed pin passage 44 of L-shaped upper frame member 40 of scissor lift assembly second side 404, respectively. Upper fixed pin 80 can be fixed in place with respect to both L-shaped upper frame members 40, while both first scissor arms 20 can be free to rotate about upper fixed pin 80. Lower fixed pin 82 can pass through fixed pin passage 64 of L-shaped lower frame member 60 and end pin passage 32 of fixed end 36 of second scissor arm 30 of scissor lift assembly first side 402, then through end pin passage 32 of fixed end 36 of second scissor arm 30 and fixed pin passage 64 of L-shaped lower frame member 60 of scissor lift assembly second side 404, respectively. Lower fixed pin 82 can be fixed in place with respect to both L-shaped lower frame members 60 while both second scissor arms 30 can be free to rotate about lower fixed pin 82. Central trunnion 100 can pass through central trunnion passage 34 of second scissor arm 30 and central trunnion passage 24 of first scissor arm 20 of scissor lift assembly first side 402, then through central trunnion passage 24 of first scissor arm 20 and central trunnion passage 34 of second scissor arm 30 of scissor lift assembly second side 404, respectively. Both first scissor arms 20 and both second scissor arms 30 can be free to rotate about central trunnion 100. Upper sliding pin 90 can pass through sliding pin slot 48 of L-shaped upper member 40 and end pin passage 32 of sliding end 38 of second scissor arm 30 of scissor lift assembly first side 402, then through end pin passage 32 of sliding end 38 of second scissor arm 30 and sliding pin slot 48 of L-shaped upper frame member 40 of scissor lift assembly second side 404. Upper sliding pin 90 can be free to slide back and forth within sliding pin slots 48 of L-shaped upper frame members 40. Lower sliding pin 91 can pass through sliding pin slot 68 of L-shaped lower frame member 60 and end pin passage 22 of sliding end 28 of first scissor arm 20 of scissor lift assembly first side 402, then through end pin passage 22 of sliding end 28 of first scissor arm 20 and sliding pin slot 68 of L-shaped lower frame member 60 of scissor lift assembly second side 404. Lower sliding pin 91 can be free to slide back and forth within sliding pin slots 68 of L-shaped lower frame members 60. When scissor lift assembly 400 is in a fully-collapsed position as seen in FIG. 1, first scissor arms 20 and second scissor arms 30 can be oriented substantially horizontal, wherein upper sliding pin 90 and lower sliding pin 91 can be a maximum distance away from upper fixed pin 80 and lower fixed pin 82, respectively, and central trunnion 100 can rest in trunnion recesses 66 of L-shaped lower frame members 60 while trunnion recesses 46 of L-shaped upper frame members 40 can rest on central trunnion 100. As scissor lift assembly 400 is raised to a fully extended position as seen in FIGS. 2 and 3, L-shaped upper frame members 40 can move vertically away from L-shaped lower frame members 60 as first scissor arms 20 rotate clockwise and second scissor arms 30 rotate counter-clockwise and upper sliding pin 90 and lower sliding pin 91 slide towards upper fixed pin 80 and lower fixed pin 82, respectively.

In some embodiments, L-shaped upper frame members 40 can further comprise trunnion recess 46, and L-shaped lower frame members 60 can further comprise trunnion recess 66. Trunnion recesses 46 and 66 can be positioned on main bodies 42 and 62, respectively, such that when scissor lift assembly 400 is fully collapsed, trunnion recess 46 can sit over top of central trunnion 100, while central trunnion 100 can rest in trunnion recess 66.

Referring to FIGS. 4 through 8, one embodiment of an actuator/wedge assembly 300, can be disposed in scissor lift assembly 400 at central trunnion 100 to form one embodiment of hybrid wedge jack/scissor lift lifting apparatus 410. Central trunnion 100 can fix linear actuator 110 in place with respect to scissor lift assembly 400. Wedge 120 can be attached to actuator rod 112, which can be extended and retracted by linear actuator 110. Actuator/wedge assembly 300 can be oriented such that wedge 120 can point toward upper fixed pin 80 and lower fixed pin 82.

In some embodiments, scissor lift assembly 400 can further comprise wedge roller 83 positioned coaxially with upper fixed pin 80 and guided wedge roller 84 positioned coaxially with lower fixed pin 82. Wedge roller 83 and guided wedge roller 84 can be positioned between scissor lift assembly first side 402 and scissor lift assembly second side 404. Upper fixed pin 80 can pass through the center of wedge roller 83, and lower fixed pin 82 can pass through the center of guided wedge roller 84. Guided wedge roller 84 can further comprise guided wedge roller main body 85 with wedge guides 86 disposed at each end. The diameter of wedge guides 86 can be greater than that of guided wedge roller body 85, and the spacing between wedge guides 86 can be such that wedge 120 can rest on guided roller main body 85 while wedge guides 86 can prevent lateral movement of wedge 120. Scissor lift assembly 400 can be at its lowest point when wedge roller 83 rests against guided wedge roller 84.

In some embodiments, hybrid wedge jack/scissor lift lifting apparatus 410 can be at its lowest point with linear actuator 110 and actuator rod 112 fully retracted and wedge roller 83 resting against guided wedge roller 84. As linear actuator 110 extends actuator rod 112, wedge 120 can be driven between wedge roller 83 and guided wedge roller 84. Wedge surface 122 can push up on wedge roller 83 and down on guided wedge roller main body 85, spreading upper fixed pin 80 and lower fixed pin 82 and causing scissor lift assembly 400 to extend. The process can be reversed when linear actuator 110 retracts actuator rod 112, removing wedge 120 from between wedge roller 83 and guided wedge roller main body 85, allowing scissor lift assembly 400 to collapse due to gravity.

In some embodiments, wedge 120 can further comprise wedge roller seats 124. Wedge roller seats 124 can be disposed opposite one another on wedge surface 122 and can be concave in shape. When wedge 120 is fully extended such that scissor lift assembly 400 is fully extended, wedge roller 83 and guided wedge roller 84 can sit in wedge roller seats 124, wherein hybrid wedge jack/scissor lift lifting apparatus 410 can be in an intrinsically safe position since hybrid wedge jack/scissor lift lifting apparatus 410 cannot collapse unless a force sufficient to remove wedge roller 83 and guided wedge roller 84 from wedge roller seats 124 acts on wedge 120.

In some embodiments, wedge surface 122 can comprise a convex curvature. In further embodiments, the curvature of wedge surface 122 can follow a circular arc. In other embodiments, the curvature of wedge surface can follow an exponential curve. In yet further embodiments, the curvature of wedge surface 122 can comprise a rise to run ratio of approximately 4:3 until rollers 83 and 84 are seated in roller seats 124, wherein the rise to the stroke of actuator rod 112 is approximately 1:1. In some embodiments, approximately 75% of the stroke of actuator rod 112 can be used to move rollers 83 and 84 along wedge surface 122 until the rollers reach roller seats 124, wherein approximately 25% of the stroke of actuator rod 112 can be used to seat rollers 83 and 84 in roller seats 124. In some embodiments, the curvature of wedge surface 122 can be selected wherein the same force can be exerted by actuator 110 throughout the entire stroke of actuator rod 112 to move rollers 83 and 84 along wedge surface 122 until roller seats 124. If wedge surface 122 were straight or linear, then the force required to move rollers 83 and 84 thereon would vary throughout the stroke of actuator rod 112, such that the force to be exerted by actuator 110 would range from a minimum value to a maximum value. This would require selecting an actuator cylinder that could provide the maximum force required. By selecting a curvature for wedge surface 122 such that the force exerted by actuator 110 is constant throughout the stroke of actuator rod 112, a smaller actuator or cylinder can be used for actuator 110.

In some embodiments, the apparatus can comprise rise to stroke ratios other than 1:1. In some embodiments, an actuator 110 having an actuator rod 112 stroke length of 11.5 inches can be used to achieve a lift of 14 inches. In these embodiments, a 100 ton force actuator can be used to lift a 50 ton load. In other embodiments, an actuator 110 having an actuator rod 112 stroke length of 20 inches can be used to achieve a lift of 14 inches.

Figure 15:
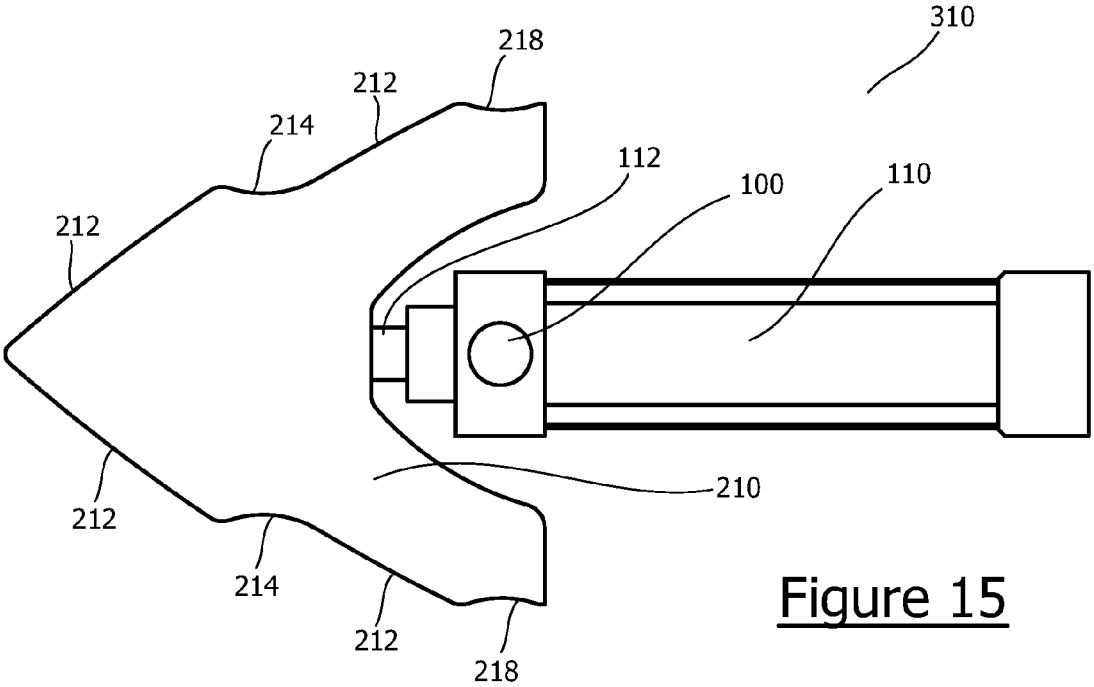
FIG. 15 is a side elevation view depicting a second embodiment of an actuator/wedge assembly.
Figure 16:
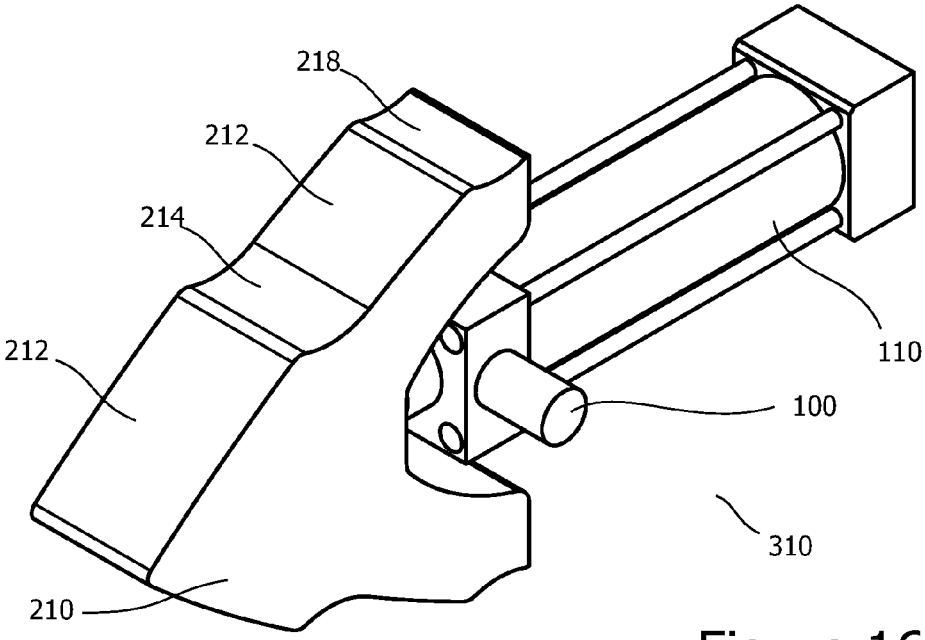
FIG. 16 is a perspective view depicting the actuator/wedge assembly of FIG. 15.

Referring to FIGS. 15 and 16, in some embodiments, actuator/wedge assembly 300 can be replaced by a second embodiment of an actuator/wedge assembly 310, which can comprise modified wedge 210 with first wedge roller seats 214 and second wedge roller seats 218 along wedge surface 212. Replacing actuator/wedge assembly 300 with actuator/wedge assembly 310 in hybrid wedge jack/scissor lift lifting apparatus 410 or any other embodiment of the hybrid wedge jack/scissor lift lifting apparatus can provide a second intrinsically safe position due to the addition of first wedge roller seats 214.

Figure 18:
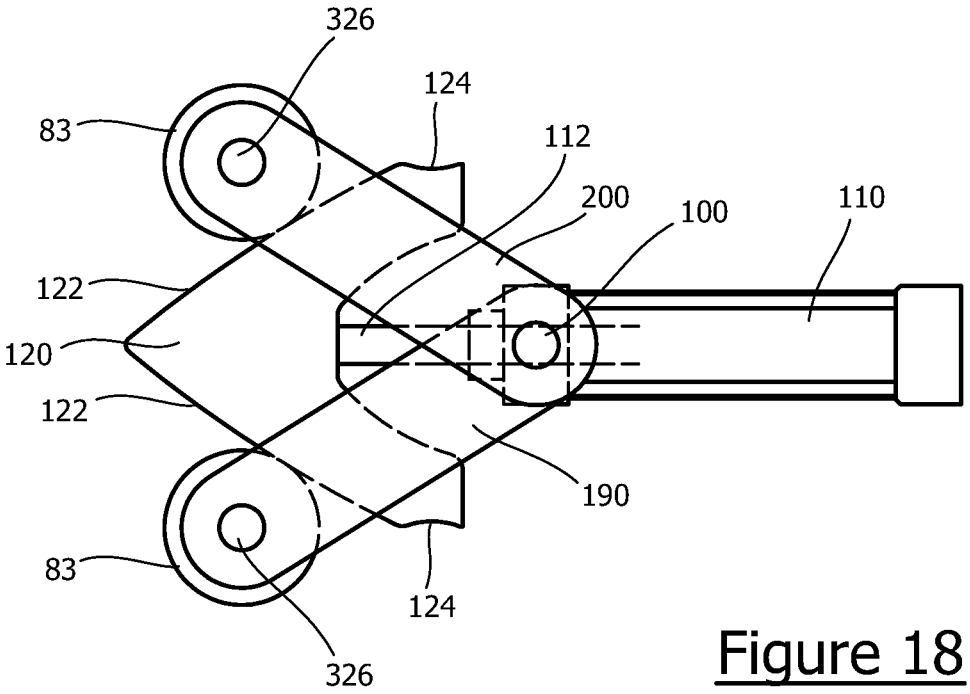
FIG. 18 is a side elevation view depicting an assembly comprising a lever arm and the actuator/wedge assembly of FIG. 7.
Figure 19:
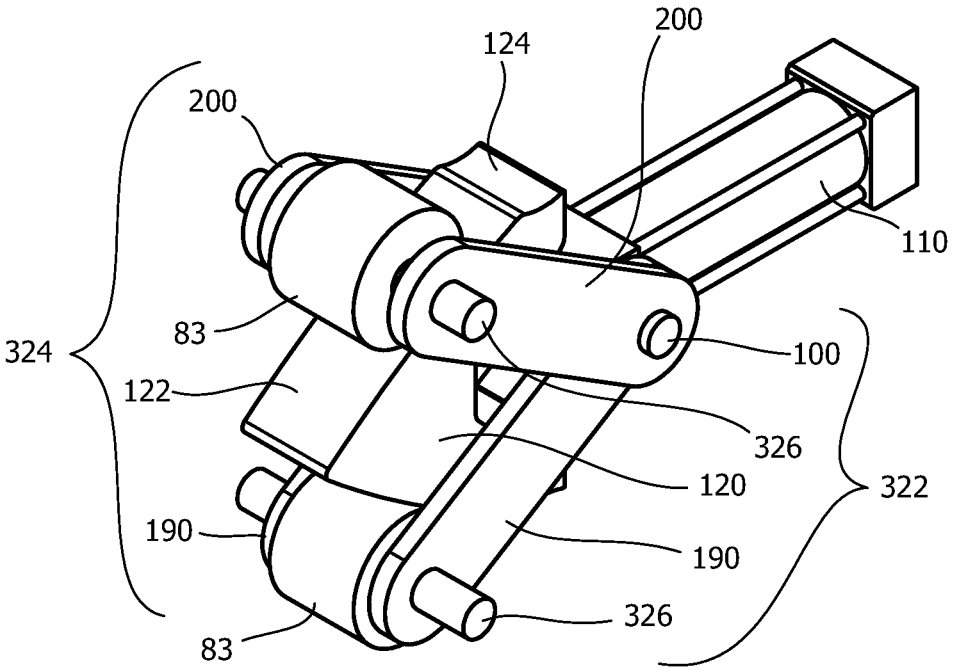
FIG. 19 is a perspective view depicting the assembly of FIG. 18.

Referring to FIGS. 18 and 19, an embodiment of an actuator/wedge/lever arm assembly is shown. Actuator/wedge/lever arm assembly 320 can comprise first side 322 and second side 324 connected by lever pins 326 and central trunnion 100. First side 322 and second side 324 can further comprise first lever arm 190 and second lever arm 200. First lever arm 190 can further comprise end pin passage 192 for receiving lever pin 326 and end trunnion passage 194 for receiving central trunnion 100. Second lever arm 200 can further comprise end pin passage 202 for receiving lever pin 326 and end trunnion passage 204 for receiving central trunnion 100. Central trunnion 100 can fix linear actuator 110 in place with respect to first lever arms 190 and second lever arms 200. Wedge 120 can be attached to actuator rod 112, which can be extended and retracted by linear actuator 110. Wedge 120 can be oriented such that it points toward lever pins 326. Wedge rollers 83 are positioned coaxially with lever pins 326 between actuator/wedge/lever arm assembly first side 322 and actuator/wedge/lever arm assembly first side 324. Lever arm pins 326 can pass through the centers of wedge rollers 83. As linear actuator 110 extends actuator rod 112, wedge 120 can be driven between wedge rollers 83. Wedge surface 122 can spread wedge rollers 83 apart, causing first lever arms 190 to rotate counter-clockwise and second lever arms 200 to rotate clockwise. The process can be reversed when linear actuator 110 retracts actuator rod 112, removing wedge 120 from between wedge rollers 83 and allowing wedge rollers 83 to move towards each other.

Referring to FIGS. 9 through 12, in some embodiments, variations of the wedge jack/scissor lift hybrid lifting apparatus can further comprise one or more restraint bar safety systems. Each restraint bar safety system can further comprise restraint bar 150, having restraint bar pin passage 152, sliding pin seats 154 and actuated end 156, and restraint bar actuator 160, having restraint bar actuator rod 161 attached to clevis 170. Each of the restraint bar safety systems can be associated with either an L-shaped upper frame member 40, upper fixed pin 80 and upper sliding pin 90, or an L-shaped lower frame member 60, lower fixed pin 82 and lower sliding pin 92.

In some embodiments, the restraint bar safety system associated with L-shaped lower frame member 60 of scissor lift assembly first side 402, lower fixed pin 82 and lower sliding pin 91, lower fixed pin 82 can extend out through L-shaped lower frame member 60 and pass through restraint bar pin passage 152. Restraint bar 150 can be free to rotate about the lower fixed pin 82. Actuated end 156 of restraint bar 150 can be located at the end opposite restraint bar pin passage 152. Actuated end 156 can be offset from clevis 170 by restraint bar spacer 166. Actuated end 156, restraint bar spacer 166 and clevis 170 can be fastened together by restraint bar bolt 168 and restraint bar nut 169. Restraint bar actuator cylinder 159 can be offset from L-shaped lower frame member 60 by frame member spacer 162. Restraint bar actuator cylinder 159, frame member spacer 162 and lower frame member 60 can be fastened together by frame member bolt 164 and frame member nut 165. Restraint bar actuator 160 can be oriented such that when restraint bar actuator rod 161 extends, actuated end 156 of restraint bar 150 can swing out and away from flange 72 L-shaped lower frame member 60. When restraint bar actuator 160 is extended far enough that sliding pin seats 154 of the restraint bar 150 are clear of lower sliding pin 91, hybrid wedge jack/scissor lift lifting apparatus 420 can be free to extend and collapse. When restraint bar actuator 160 is retracted such that restraint bar 150 is in a position where lower sliding pin 91 rests in one of the sliding pin seats 154, such as the position shown in FIG. 11, the restraint bar safety system can be engaged. In this position, hybrid wedge jack/scissor lift lifting apparatus 420 is prevented from collapsing as lower fixed pin 91 presses into sliding pin seat 154 of restraint bar 150.

Figure 9:
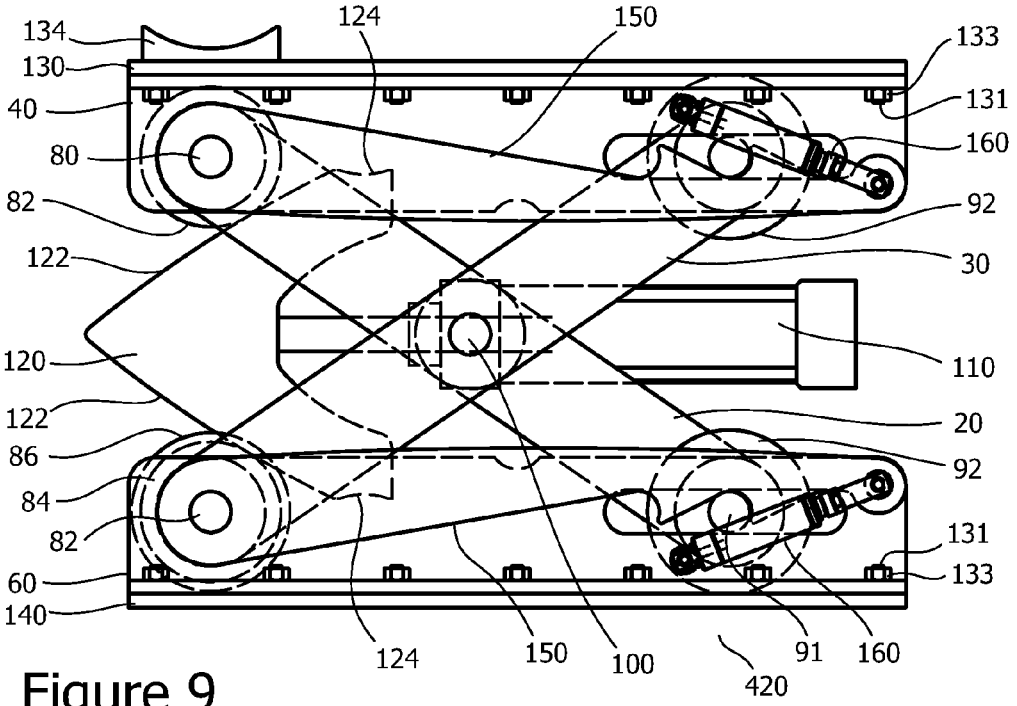
FIG. 9 is a side elevation view depicting a second embodiment of a hybrid wedge jack/scissor lift lifting apparatus in a partially extended position.
Figure 10:
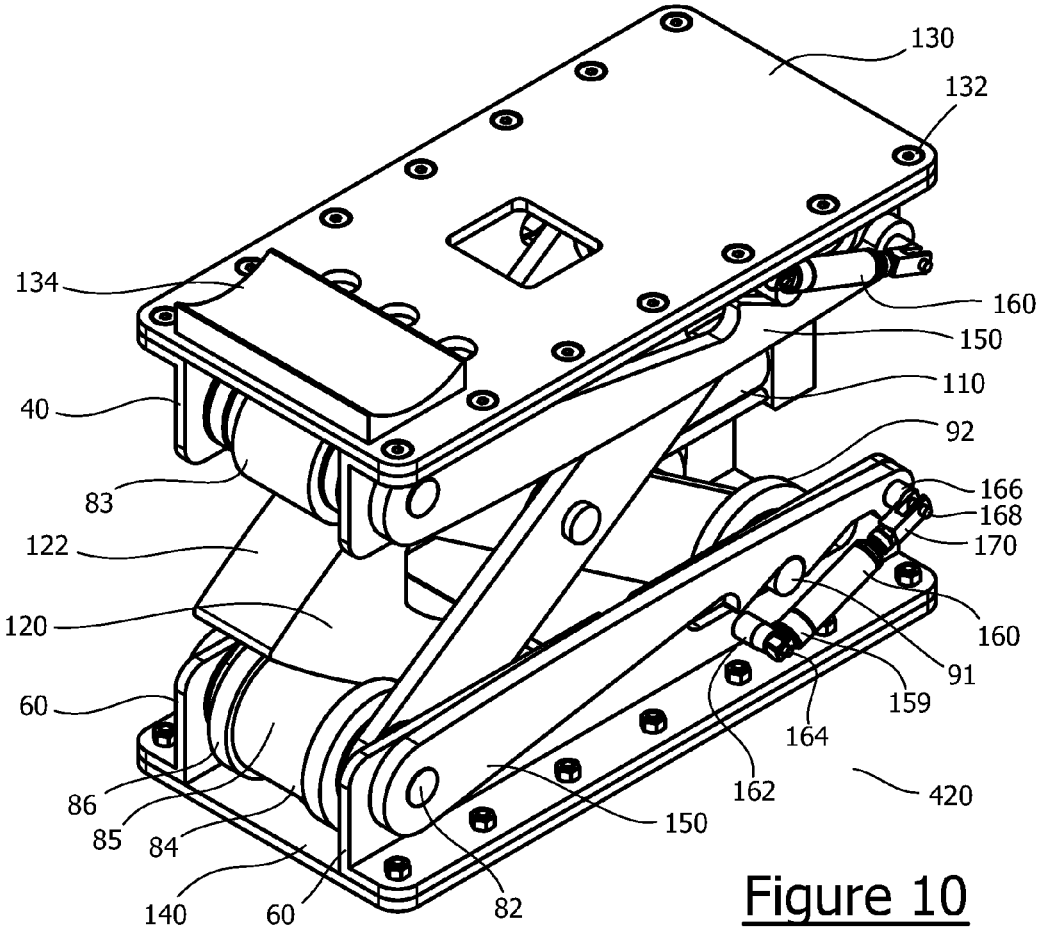
FIG. 10 is a perspective view depicting the hybrid wedge jack/scissor lift lifting apparatus of FIG. 9.

Referring to FIGS. 9 and 10, an embodiment of a hybrid wedge jack/scissor lift lifting apparatus 420 is shown. Hybrid wedge jack/scissor lift lifting apparatus 420 can further comprise four restraint bar safety systems having restraint bars 150 and restraint bar actuators 160, load plate 130 and base plate 140. Load plate 130 can further comprise plate bolt passages 132 projecting through load plate 130 and aligning with flange bolt passages 54 and cradle 134 fixed to the surface of load plate 130. Load plate 130 can be secured to L-shaped upper frame members 40 with plate bolts 131 inserted through plate bolt passages 132 and flange bolt passages 54, respectively, with plate bolts 131 secured in place with plate nuts 133. Cradle 134 can be oriented and shaped to prevent loads from shifting atop load plate 130. Base plate 140 can further comprise plate bolt passages 142 projecting through base plate 140 and aligning with flange bolt passages 74. Base plate 140 can be secured to L-shaped lower frame members 60 with plate bolts 131 inserted through plate bolt passages 142 and flange bolt passages 74, respectively, with plate bolts 131 secured in place with plate nuts 133. Load plate 130 and base plate 140 can improve the structural integrity or rigidity of top frame 40 and lower frame 60, respectively, of scissor lift assembly 400 while load plate 130 and cradle 134 can allow hybrid wedge jack/scissor lift lifting apparatus 420 to better handle loads placed atop it.

In some embodiments, hybrid wedge jack/scissor lift lifting apparatus 420 can further comprise support discs 92 positioned coaxially with upper sliding pin 90 and lower sliding pin 91. Upper sliding pin 90 and lower sliding pin 91 can each pass through the center of two support discs 92, with support discs 92 associated with upper sliding pin 90 being positioned adjacent to second scissor arms 30 and support discs 92 associated with lower sliding pin 91 being positioned between first scissor arms 20 and L-shaped lower frame members 60.

Figure 11:
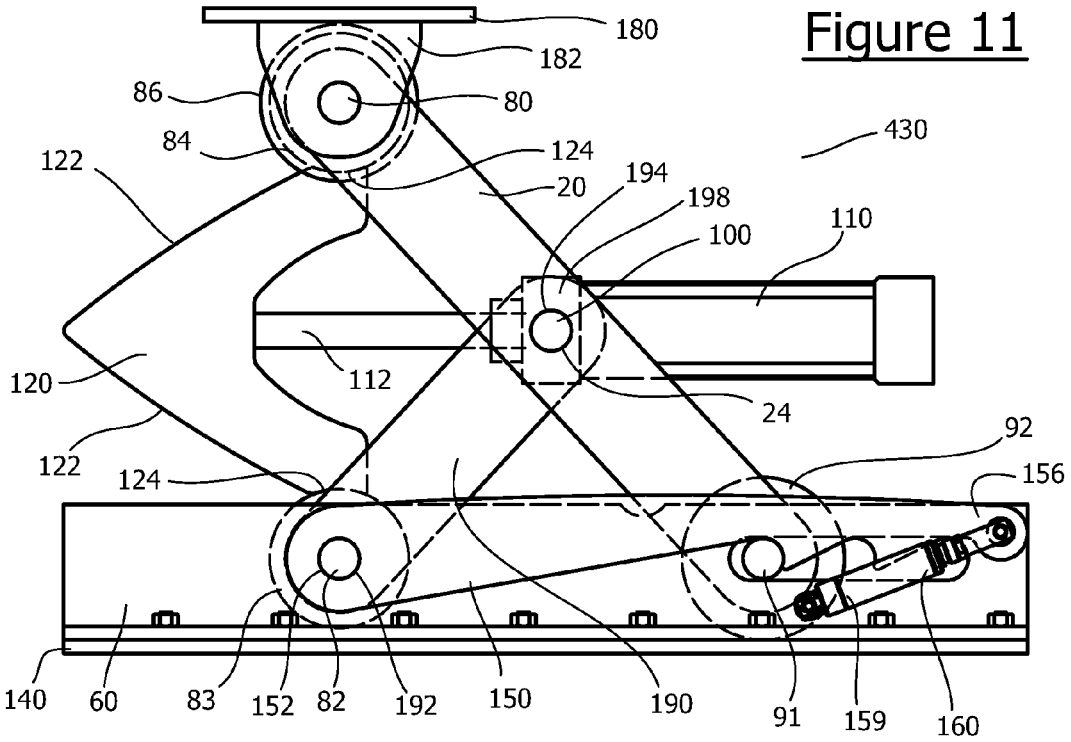
FIG. 11 is a side elevation view depicting a third embodiment of a hybrid wedge jack/scissor lift lifting apparatus in a fully extended position.
Figure 12:
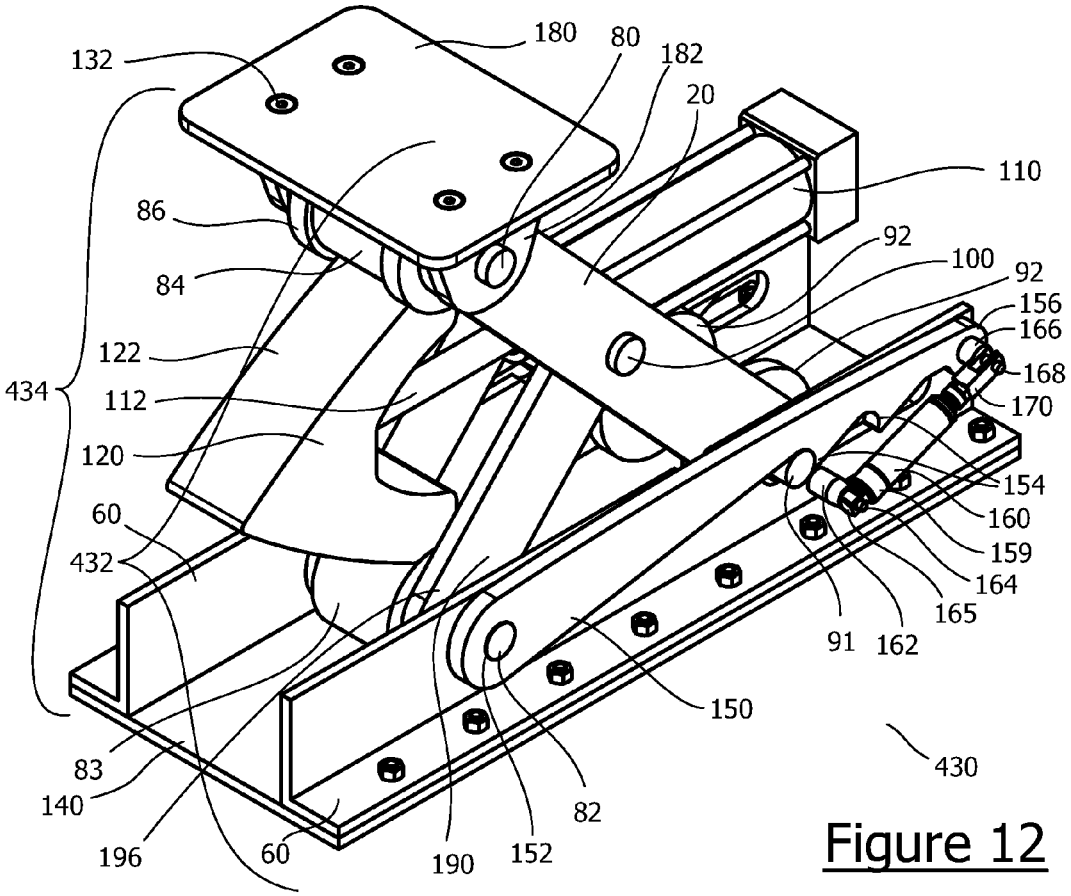
FIG. 12 is a perspective view depicting the hybrid wedge jack/scissor lift lifting apparatus of FIG. 11.

Referring to FIGS. 11 and 12, another embodiment, hybrid wedge jack/scissor lift lifting apparatus 430, is shown. Hybrid wedge jack/scissor lift lifting apparatus 430 can comprise a scissor lift assembly having compact load plate 180 with load plate flanges 182, and hybrid wedge jack/scissor lift lifting apparatus first side 432 and hybrid wedge jack/scissor lift lifting apparatus second side 434 connected by upper fixed pin 80, lower fixed pin 82, lower sliding pin 91 and central trunnion 100. Hybrid wedge jack/scissor lift lifting apparatus first side 432 and hybrid wedge jack/scissor lift lifting apparatus second side 434 can further comprise first scissor arm 20, first lever arm 190 and L-shaped lower frame member 60. First scissor arm 20 can further comprise fixed end 26 having end pin passage 22 for receiving upper fixed pin 80, sliding end 28 having end pin passage 22 for receiving sliding pin 91 and central trunnion passage 24 for receiving central trunnion 100. First lever arm 190 can further comprise first lever arm fixed end 196 having end pin passage 192 for receiving lower fixed pin 82 and first lever arm rotating end 198 having end trunnion passage 194 for receiving central trunnion 100. L-shaped lower frame member 60 can further comprise main body 62 having fixed pin passage 64, sliding pin slot 68 and trunnion recess 66 and flange 72 having flange bolt passages 74. Lower fixed pin 82 can pass through fixed pin passage 64 of L-shaped lower frame member 60 and end pin passage 192 of first lever arm fixed end 196 of hybrid wedge jack/scissor lift lifting apparatus first side 432, then through end pin passage 192 of first lever arm fixed end 196 and fixed pin passage 64 of L-shaped lower frame member 60 of hybrid wedge jack/scissor lift lifting apparatus second side 434, respectively. Upper fixed pin 80 can pass through flange pin passages 184 of load plate flanges 182 and end pin passages 22 of fixed ends 26 of first scissor arms 20. Load plate flanges 182 can be spaced apart on compact load plate 180 such that load plate flanges 182 sit outside of first scissor arms 20. Upper fixed pin 80 can be fixed in place with respect to the load plate flanges 182 and lower fixed pin 82 can be fixed in place with respect to L-shaped lower frame members 60. First lever arms 190 can be free to rotate about lower fixed pin 82. First scissor arms 20 can be free to rotate about upper fixed pin 80. Central trunnion 100 can pass through central trunnion passage 24 of first scissor arm 20 and end trunnion passage 194 of first lever arm 190 of hybrid wedge jack/scissor lift lifting apparatus first side 432, then through end trunnion passage 194 of first lever arm 190 and central trunnion passage 24 of first scissor arm 20 of hybrid wedge jack/scissor lift lifting apparatus second side 434, respectively. First lever arms 190 and first scissor arms 20 can rotate freely about central trunnion 100. Lower sliding pin 82 can pass through sliding pin slot 68 of L-shaped lower frame member 60 and end pin passage 22 of sliding end 28 of first scissor arm 20 of hybrid wedge jack/scissor lift lifting apparatus first side 432, then through end pin passage 22 of sliding end 28 of first scissor arm 20 and sliding pin slot 68 of L-shaped lower frame member 60 of hybrid wedge jack/scissor lift lifting apparatus second side 434, respectively. First scissor arms 20 can rotate freely about lower sliding pin 91. Lower sliding pin 91 can be free to slide back and forth within the sliding pin slots 68 of L-shaped lower frame members 60.

In some embodiments, hybrid wedge jack/scissor lift lifting apparatus 430 can further comprise wedge roller 83 positioned coaxially with lower fixed pin 82, and guided wedge roller 84 positioned coaxially with upper fixed pin 80. Wedge roller 83 and guided wedge roller 84 can be positioned between hybrid wedge jack/scissor lift lifting apparatus first side 432 and hybrid wedge jack/scissor lift lifting apparatus second side 434. Upper fixed pin 80 can pass through the center of guided wedge roller 84, and lower fixed pin 82 can pass through the center of wedge roller 83. Hybrid wedge jack/scissor lift lifting apparatus 430 can be at its lowest point with linear actuator 110 and actuator rod 112 fully retracted and wedge roller 83 resting against guided wedge roller 84. As linear actuator 110 extends actuator rod 112, wedge 120 can be driven between wedge roller 83 and guided wedge roller 84. Wedge surface 122 can push down on wedge roller 83 and up on guided wedge roller main body 85, spreading upper fixed pin 80 and lower fixed pin 82 and causing compact load plate 180 to extend upward. The process can be reversed when linear actuator 110 retracts actuator rod 112, removing wedge 120 from between wedge roller 83 and guided wedge roller main body 85, allowing gravity to pull compact load plate 180 down.

In some embodiments, hybrid wedge jack/scissor lift lifting apparatus 430 can further comprise support discs 92 positioned coaxially with lower sliding pin 91. Lower sliding pin 91 can pass through the center of two support discs 92, with each support disc 92 being positioned between first scissor arms 20 and L-shaped lower frame members 60.

Figure 13:
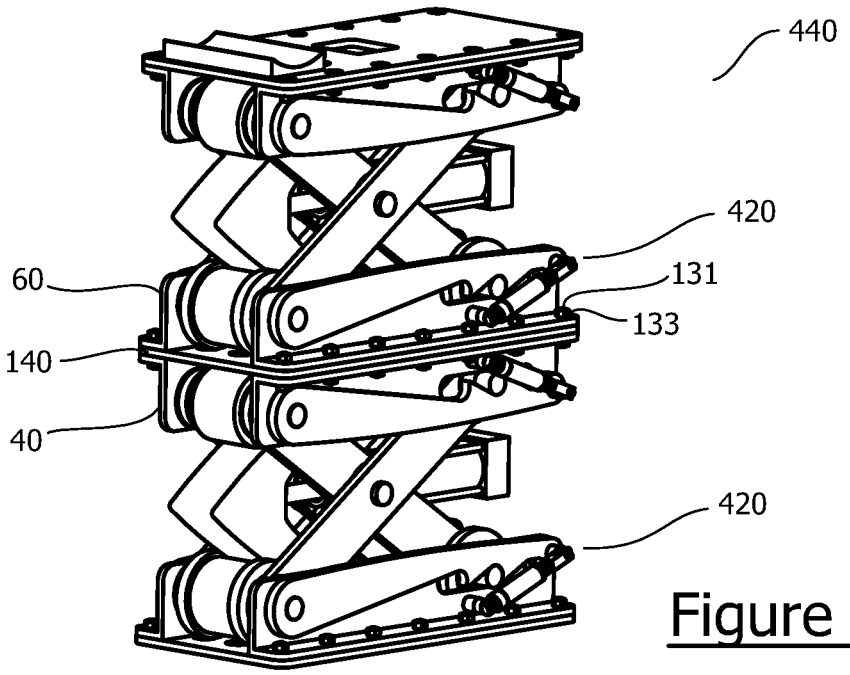
FIG. 13 is a perspective view depicting a vertical tandem hybrid wedge jack/scissor lift lifting apparatus.

Referring to FIG. 13, a vertical tandem hybrid wedge jack/scissor lift lifting apparatus 440 is shown. Vertical tandem hybrid wedge jack/scissor lift lifting apparatus 440 can comprise two hybrid wedge jack/scissor lift lifting apparatuses 420 stacked on top of one another, attached by joining L-shaped upper frame members 40 of the lower hybrid wedge jack/scissor lift lifting apparatus 420 to the corresponding L-shaped lower frame members 60 of the upper hybrid wedge jack/scissor lift lifting apparatus 420 by placing plate bolts 131 through flange bolt passages 74 on L-shaped lower frame members 60, then through plate bolt passages 142 on base plate 140, then through flange bolt passages 54 on L-shaped upper frame members 40 and securing them in place with plate nuts 133.

Figure 14:
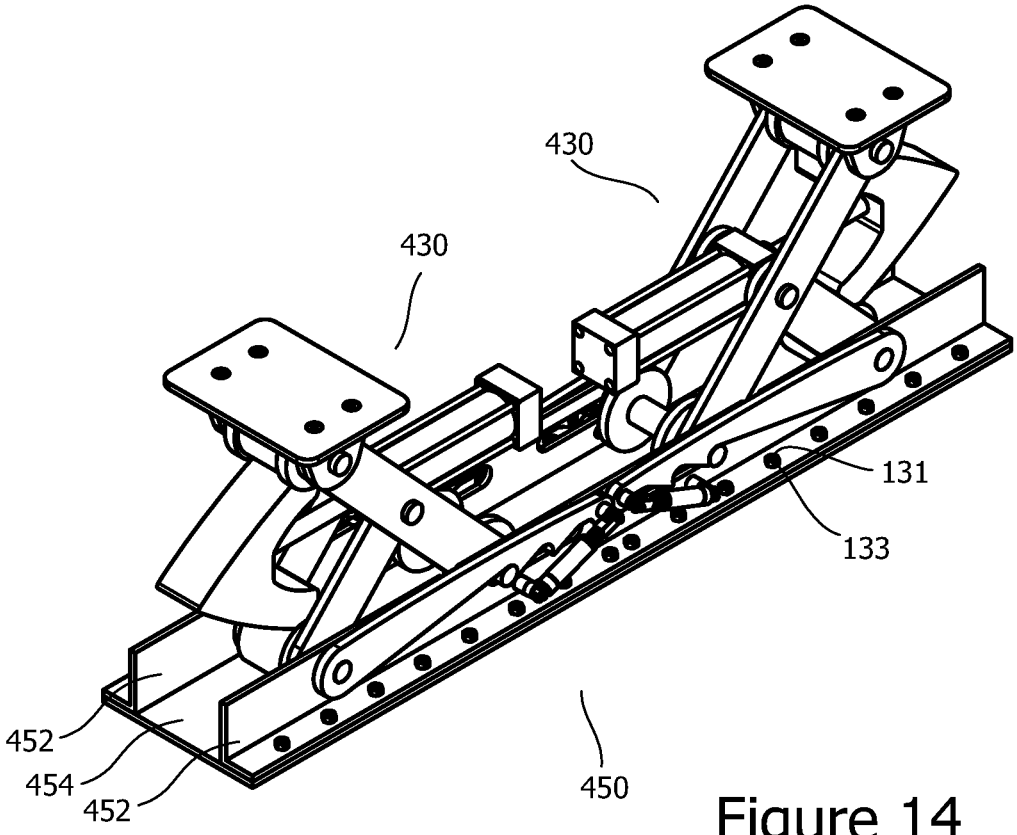
FIG. 14 is a perspective view depicting a horizontal tandem hybrid wedge jack/scissor lift lifting apparatus.

Referring to FIG. 14, a horizontal tandem hybrid wedge jack/scissor lift lifting apparatus 450 is shown. Horizontal tandem hybrid wedge jack/scissor lift lifting apparatus 450 can comprise two hybrid wedge jack/scissor lift lifting apparatuses 430 attached together in an end-to-end configuration such that the linear actuators 110 of the two simplified wedge jack/scissor lift hybrids 430 oppose one another. Hybrid wedge jack/scissor lift lifting apparatuses 430 can be joined together by using common L-shaped lower frame members 452 and common base plate 454. Common L-shaped lower frame member 452 can be formed by attaching two L-shaped lower frame members 60 in an end-to-end configuration, with sliding pin slots 68 of each L-shaped lower frame member 60 adjacent to one another. Common base plate 454 can further comprises plate bolt passages 142. Plate bolts 131 pass through plate bolt passages 142 and flange bolt passages 74 of common L-shaped lower frame members 452 and can be fixed in place with plate nuts 133.

Figure 17:
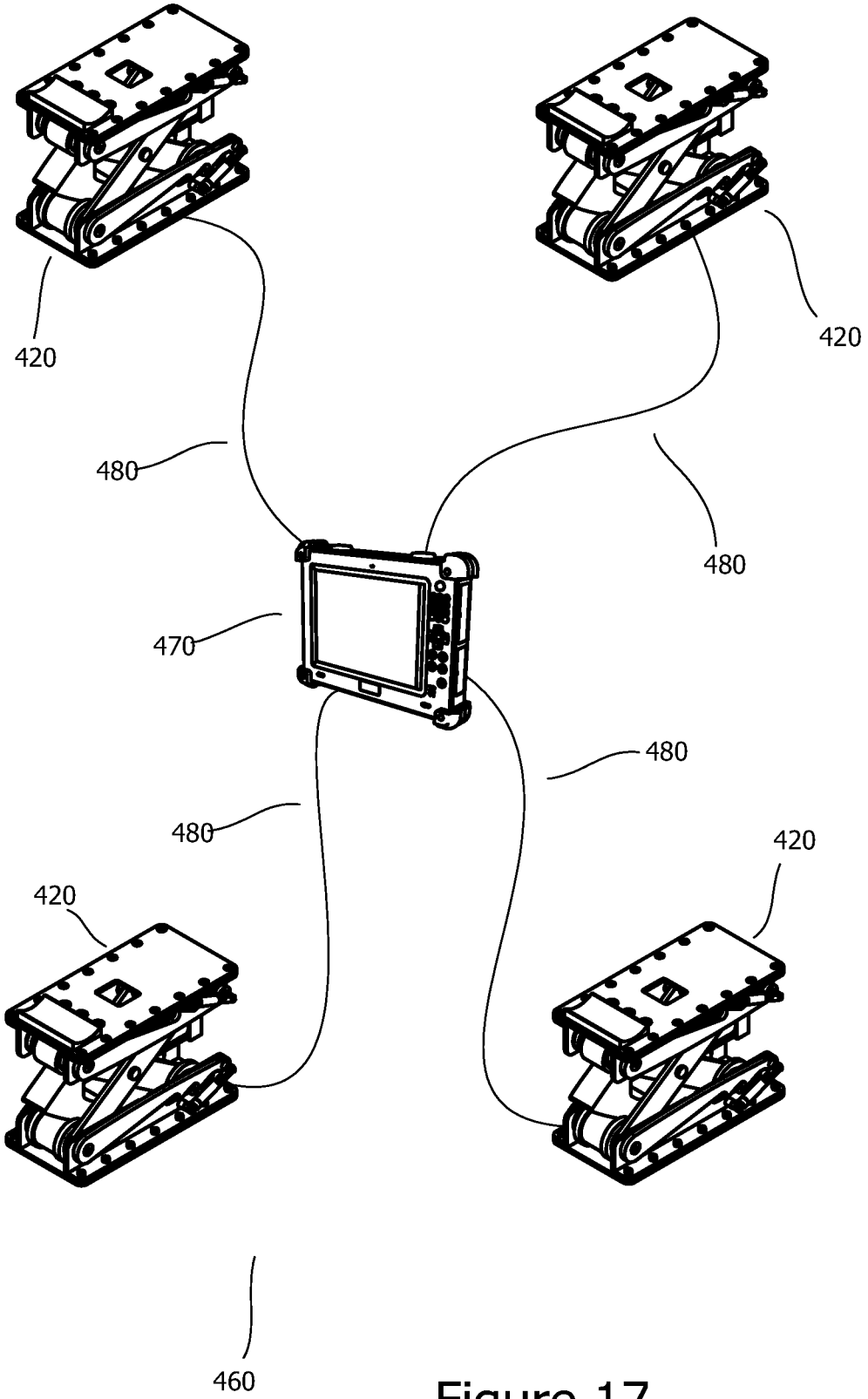
FIG. 17 is a block diagram depicting a centrally-controlled hybrid wedge jack/scissor lift lifting apparatus array.

Referring to FIG. 17, a centrally-controlled hybrid wedge jack/scissor lift lifting apparatus array 460 is shown, comprising four hybrid wedge jack/scissor lift lifting apparatuses 420 controlled by controller 470. Controller 470 can be connected to each improved wedge jack/scissor lift hybrid 420 via control cables 480.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A lifting apparatus, comprising: a) a scissor lift assembly, further comprising:

i) an upper frame operatively disposed above a lower frame, ii) a pair of scissor braces operatively disposed between the upper frame and the lower frame, each brace further comprising first and second arms pivotally attached to each other, each arm further comprising a first end and a second end, iii) a first fixed pin pivotally attaching the first end of the first arms to the upper frame, and a second fixed pin pivotally attaching the first end of the second arms to the lower frame, wherein the scissor lift assembly further comprises a first roller rotatably disposed about the first fixed pin, and a second roller rotatably disposed about the second fixed pin, iv) a first sliding pin disposed in a first slot disposed in the upper frame, the first sliding pin further disposed through the second end of the second arms wherein the first sliding pin can move along the first slot, and v) a second sliding pin disposed in a second slot disposed in the lower frame, the second sliding pin further disposed through the second end of the first arms wherein the second sliding pin can move along the second slot; b) a linear actuator disposed between the upper frame and the lower frame, the linear actuator configured to extend and retract; and c) a wedge comprising upper and lower wedge surfaces, the wedge operatively coupled to the linear actuator, the wedge configured to extend between the first fixed pin and the second fixed pin when the linear actuator is extended wherein the upper frame can be raised relative to the lower frame when the linear actuator is extended, wherein the upper frame can be lowered relative to the lower frame when the linear actuator is retracted, and wherein the wedge extends between the rollers when the linear actuator is extended.

2. The lifting apparatus as set forth in claim 1, wherein the wedge further comprises at least one first concave indentation disposed on the upper wedge surface, and at least one second concave indentation disposed on the lower wedge surface, the at least one first and second concave indentations shaped to receive the first roller and the second roller, respectively, wherein retracting the wedge from a position where the rollers are resting in the first and second at least one concave indentations requires sufficient force to raise the upper frame slightly upward.

3. A lifting apparatus, comprising: a) a scissor lift assembly, further comprising:

i) an upper frame operatively disposed above a lower frame, ii) a pair of first arms operatively disposed between the upper frame and the lower frame, each first arm further comprising a first end and a second end, iii) a second arm comprising a first end and a second, the first end of the second arm pivotally attached to the first arm, iv) a first fixed pin pivotally attaching the first end of the first arms to the upper frame, and a second fixed pin pivotally attaching the second end of the second arms to the lower frame, wherein the scissor lift assembly further comprises a first roller rotatably disposed about the first fixed pin, and a second roller rotatably disposed about the second fixed pin, and v) a sliding pin disposed in a slot disposed in the lower frame, the sliding pin further disposed through second end of the first arms wherein the sliding pin can move along the slot, b) a linear actuator disposed between the upper frame and the lower frame, the linear actuator configured to extend and to retract; and c) a wedge comprising upper and lower wedge surfaces, the wedge operatively coupled to the linear actuator, the wedge configured to extend between the first fixed pin and the second fixed pin when the linear actuator is extended wherein the upper frame can be raised relative to the lower frame when the linear actuator is extended, wherein the upper frame can be lowered relative to the lower frame when the linear actuator is retracted, and wherein the wedge extends between the rollers when the linear actuator is extended.

4. The lifting apparatus as set forth in claim 3, wherein the wedge further comprises at least one first concave indentation disposed on the upper wedge surface, and at least one second concave indentation disposed on the lower wedge surface, the at least one first and second concave indentations shaped to receive the first roller and the second roller, respectively, wherein retracting the wedge from a position where the rollers are resting in the at least first and second concave indentations requires sufficient force to raise the upper frame slightly upward.

* * * * *